United States Patent [19]

Wilisch

[11] 4,168,664

[45] Sep. 25, 1979

[54] BRAKING BUFFER DEVICE FOR BUFFER STOP ASSEMBLIES

[76] Inventor: Erhart Wilisch, Ernst-Sievers-Strasse 103, 4500 Osnabruck, Fed. Rep. of Germany

[21] Appl. No.: 886,920

[22] Filed: Mar. 15, 1978

[30] Foreign Application Priority Data

Mar. 18, 1977 [DE] Fed. Rep. of Germany ..... 2711819

[51] Int. Cl.[2] ..... B61K 7/00

[52] U.S. Cl. ..... 104/254; 104/259; 188/63; 188/67

[58] Field of Search ..... 188/63, 67, 129; 293/60, 86; 267/9 A; 213/220; 104/254, 259

[56] References Cited

U.S. PATENT DOCUMENTS

| | | | |
|---|---|---|---|
| 330,671 | 11/1885 | Bonzano | 104/259 |
| 829,760 | 8/1906 | Blanc et al. | 188/129 |
| 1,084,463 | 1/1914 | McDonald | 104/259 X |
| 1,581,490 | 4/1926 | McKaig | 188/129 X |

FOREIGN PATENT DOCUMENTS

| | | | |
|---|---|---|---|
| 230427 | 12/1963 | Austria | 104/254 |
| 330140 | 12/1920 | Fed. Rep. of Germany | 104/254 |
| 1140964 | 12/1962 | Fed. Rep. of Germany | 104/254 |
| 234005 | 5/1925 | United Kingdom | 104/254 |
| 240571 | 10/1925 | United Kingdom | 188/129 |

*Primary Examiner*—George E. A. Halvosa
*Attorney, Agent, or Firm*—Andrus, Sceales, Starke & Sawall

[57] ABSTRACT

A braking device for buffer stop assemblies comprises a buffer rail which is displaceably guided on a buffer stop construction, there being provided at least one friction element and bolts for clamping the friction element in braking frictional engagement with the buffer rail. The buffer rail is formed as a circular cross section tube having a smooth outer surface and the friction element by brake blocks engaging opposite sides of the tube and pressed against the tube by the bolts.

7 Claims, 5 Drawing Figures

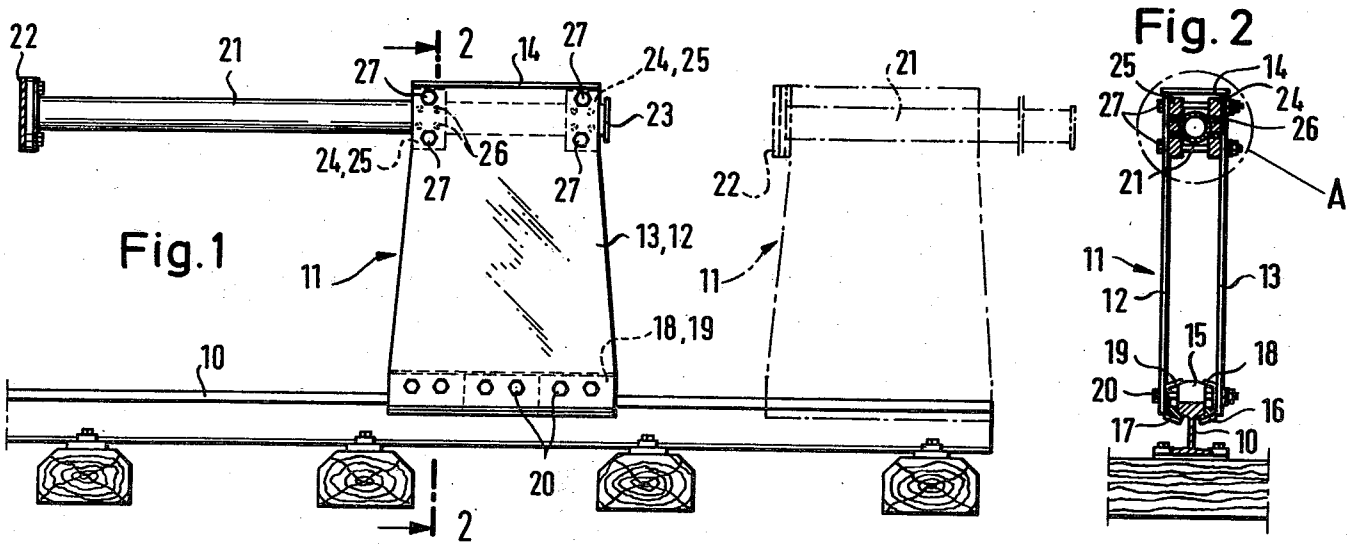
Fig. 1
Fig. 2
A
10
11
12
13
13,12
14
15
16
17
18
18,19
19
20
21
22
23
24
24,25
25
26
27
2
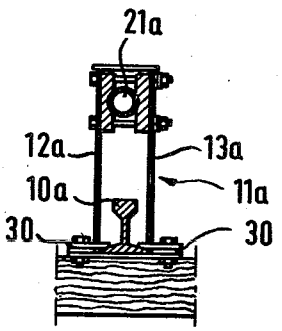
Fig. 4
10a
11a
12a
13a
21a
30
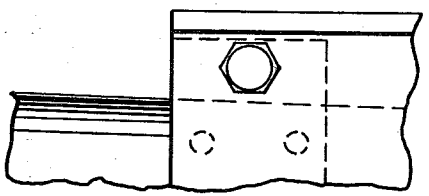
Fig. 5
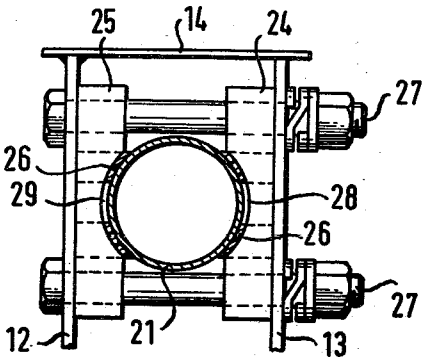
Fig. 3
12
13
14
21
24
25
26
27
28
29

BRAKING BUFFER DEVICE FOR BUFFER STOP ASSEMBLIES

BACKGROUND OF THE INVENTION

The invention relates to a braking buffer device for buffer stop assemblies, comprising at least one buffer rail which is displaceably guided on a buffer stop construction, at least one friction element and means for clamping the friction element in braking frictional engagement with the buffer rail.

Braking buffer devices are known (German Patent Specification No. 1,140,964). The braking elements disclosed in that specification do not slide with a braking action or a track rail but are fixed in the plane of impact, for example, at the level of the buffers of rail vehicles. On impact by the rolling stock, the buffer rails are displaced along the braking elements.

With the aid of such a braking buffer device, a progressive braking action is provided for the cases where, because of lack of space, only rigid track stops can be erected, e.g. at ramps, ship sides, on existing concrete structures, walls, etc. This braking buffer device can also be employed with braking buffer stops for attaining a stage-by-stage increase in resistance.

It is also known to guide rail-like buffer members on anchored impact frames and to bring them into braking frictional engagement with rail-like friction elements. By this means it is possible to dissipate extraordinarily high braking energies. Yet, in certain cases, the relatively sharp braking effect is a disadvantage. In the known case, the inclined surfaces of a track rail head are used as friction surfaces and a braking member of a suitable metal alloy is pressed against the friction surface.

There are numerous fields of application in which a gently braking safety stop has to be provided on the end of a track. Principally, this applies where there exists the danger of high structures, running on rail tracks, tipping over, as in the case of cranes. In order to prevent a crane coming off the track and turning over because of wind pressure, the track ends are provided with buffer stops. The use of the known forms of braking buffer device or track braking stop is, however, not without problems because of the too sharp braking action, so that the danger of turning over still exists.

SUMMARY OF THE PRESENT INVENTION

The essential task of the invention is to provide a braking buffer which generates a relatively gentle braking action.

According to the invention, this task is resolved in that the buffer rail is formed as a tube and the friction body by brake blocks engaging opposite sides of the tube and pressed against it by clamping means.

Whilst in the known case the inclined surfaces of the rail head are provided with an uneven rolled surface as a friction surface, the invention proposes to use a smooth tube which is partly embraced by two concave brake blocks which can be held against the tube with accurately calculable clamping forces. For this purpose brake screws with double spring washers may be used. For calculating the brake force, only the torque on the screws needs to be taken into account, without, as in the known case, a wedge action having to be included.

The brake device according to the invention enables a relatively gentle response and a gradual acceptance of the impact energy, which is particularly advantageous in crane buffer stops. There are, however, numerous other applications conceivable, for example the tube may be braked vertically, perhaps for the braking of conveyor baskets, or the like.

As already mentioned, preferably the tube has a smoothly worked outer surface, and for special applications the use of non-rusting material is also conceivable. A preferred embodiment has a circular cross-section tube. The most favourable results are obtained with respect to the material to be used with predetermined braking action.

At least two brake blocks engage the tube on opposite sides thereof. Preferably, at least two spaced pairs of blocks are employed, which are concavely shaped to embrace the tube. In one embodiment of the invention, it is thus provided that each block comprises two block- or curved braking elements arranged one above the other. The concave blocks serve, in this case, as retaining elements for the braking elements which project somewhat from the blocks and can be brought into frictional engagement with the outer surface of the tube. The outer ends of the braking elements are preferably curved to match the surface curvature of the tube, in order to avoid point or lineal frictional contact.

In order to compensate for a reduced braking force through wear of the braking elements when they are used frequently, a further embodiment of the invention provides that automatic adjustment means cooperate with the braking elements. In the simplest case, such means can be formed by springs which tend to urge the braking elements against the tube. Wear can also be compensated for by packing the braking elements from behind with sheets of packing.

In the event that a gentle response with a steady increase of the braking effect is required, a further embodiment of the invention provides that the outer dimensions of the tube steadily increase from the rear forwards. With a tube having a circular cross-section it is, in this case, slightly conical in shape.

As already mentioned, the brake blocks can be pressed against the tube by brake screws. In order to obtain an even contact pressure, the brake screws are disposed on opposite sides of the tube, at right angles to the blocks. Consequently, the braking elements only require half the installation length compared to the braking elements in the known braking buffer device.

BRIEF DESCRIPTION OF THE DRAWING

An embodiment of the invention will now be described in greater detail, reference being made to the accompanying drawings, in which:

FIG. 1 is a view of a buffer stop assembly, including a buffer device, according to the invention, in two different positions, one position being shown in solid lines and the other in chain lines, FIG. 2, is a section along the line 2—2 through an impact frame of the buffer stop assembly of FIG. 1, FIG. 3, shows, on an enlarged scale, the detail A of the section of FIG. 2, and FIG. 4 is a section, corresponding to FIG. 2 but through another form of impact frame.

FIG. 5 is a fragmentary perspective view showing a modification of the buffer device.

DETAILED DESCRIPTION OF THE PREFERRED EMBODIMENT

On a track 10, for example a crane track, impact frames or triangles of a braking buffer stop assembly are arranged, one of which one is indicated at 11 in FIGS. 1 and 2. Essentially, the impact frame consists of two parallel spaced plates 12, 13 which are closed on the top by a metal plate 14. Between the plates, on the head of the track rail, a cast iron part 15 is arranged, whilst braking elements 16,17 engage the underside of the rail head, the braking elements being made of a suitable metal alloy. Stirrup-like holders 18, 19 hold the cast iron part 15 and the braking elements 16, 17, and the latter are pressed against the rail head by means of brake screws 20. The brake screws 20 serve at the same time for fixing the plates 12, 13 to the outer side of the holders 18, 19. This construction of a braking buffer stop assembly is known per se.

A smooth tube 21 with a circular cross-section is guided in the upper area between the plates 12, 13 of the impact frame 11, and is provided with a buffer pad 22 at the front end thereof. At the rear end, the tube is closed off by a plate 23 with a projecting rim. As best seen in FIG. 3, the tube 21 is led between opposing concave blocks 24, 25, which contact the insides of the plates 12, 13 and hold rod-like braking elements 26. With the aid of brake screws 27 extending above and below the tube respectively, the upper ends of the plates are held together and the blocks 24, 25 are pressed against the outer surface of the tube 21. As can be seen from FIG. 3, the plate 14 is only welded to the plate 12 whilst plate 13 can be moved so that the brake screws 27 can urge the blocks 24, 25 in a direction towards the tube 21. As can also be seen, concave recesses 28 and 29, respectively, matching the surface of the tube 21, are provided in the blocks 24, 25, which recesses are spaced from the surface of the tube. Only the curved braking elements 26 project from the recesses and are pressed against the surface of the tube. The end surfaces of the elements 26 which come into contact with the tube surface are shaped to match the curvature of the tube 21.

As can be seen from FIG. 1, one of the brake devices described is arranged in the front area and one in the rear area of the impact frame or triangle 11. It is to be understood that another impact frame on the other rail is fitted with a brake device in the same way.

The left-hand assembly shown in FIG. 1, in solid lines, shows the readiness position of the braking buffer stop assembly. In the right-hand assembly shown in FIG. 1, in chain lines, on the contrary, the position is shown after braking has been effected. The impact frame 11 has shifted on the track rail 10 with respect to the position shown on the left. Furthermore the tube 21 has shifted completely to the rear and the buffer pad 22 lies against the front side of the impact frame. As the tube offers less braking resistance because of its smooth outer surface, during an impact it is first actuated and pushed backwards before the impact frame absorbs further braking energy.

The impact frame according to FIG. 4 is similarly constructed to that according to FIG. 2. The only essential difference is that the plates **12*a*, 13*a* are fitted securely to the track rail 10*a* by claw-like securing means 30. In this construction, only the tube 21** dissipates the impact energy.

Although an embodiment for a crane track buffer stop has been described in detail, it is to be understood that the invention can be applied to all buffer stop constructions.

I claim:

1. A buffer stop assembly for applying controlled deceleration forces to a vehicle mounted on rails of a track, said assembly comprising:

an impact frame mounted in association with each of said track rails, each said impact frame having a pair of parallel, vertically oriented, horizontally spaced plates straddling one of said track rails; and a braking buffer device including a buffer rail positioned on each of said frames between the impact frame plates for receiving the impact of said vehicle and moving with respect to said frames, each of said buffer rails being formed as a tube having a smooth outer surface; brake elements engaging said smooth outer surface of said tubes; and clamping means interposed between the opposing faces of each pair of said impact frame plates and said brake elements for applying the brake element to the tube in a controllable frictional engagement determining, at least in part, the deceleration forces applied to the vehicle.

2. A buffer stop assembly according to claim 1, wherein the tubes have a circular cross-section.

3. A buffer stop assembly according to claim 1, wherein each brake element features at least two curved braking blocks spacedly engaging said tube about its periphery.

4. A buffer stop assembly according to claim 3, wherein automatic means of adjustment cooperate with the braking elements for compensating for wear of the braking elements.

5. A buffer stop assembly according to claim 1 wherein the impact frames cooperate with the track rails as a friction element by means of further braking elements positioned between the pairs of plates, the further braking elements being held by means of holders against both sides of the track rails to provide a frictional engagement between said frame and track rails greater than the frictional engagement between said tube engaging brake elements and buffer rail tubes, said pairs of parallel spaced plates being fixed to the outside of the holders by brake screws.

6. A buffer stop assembly according to claim 1, wherein the impact frames are anchored to the track rails.

7. A buffer stop assembly according to claim 1, wherein the tubes steadily increase in dimension from the rear forwards.

* * * * *